US008235538B2

(12) United States Patent
Wei et al.

(10) Patent No.: US 8,235,538 B2
(45) Date of Patent: Aug. 7, 2012

(54) LED DEVICE WITH HIGH COLOR-RENDERING INDEX

(76) Inventors: Chih-Hung Wei, Taipei County (TW); Ming-Chang Wu, Taipei County (TW); Johnny Wu, Taipei County (TW)

( * ) Notice: Subject to any disclaimer, the term of this patent is extended or adjusted under 35 U.S.C. 154(b) by 522 days.

(21) Appl. No.: 12/549,360

(22) Filed: Aug. 28, 2009

(65) Prior Publication Data

US 2011/0051408 A1 Mar. 3, 2011

(51) Int. Cl.
*F21V 33/00* (2006.01)

(52) U.S. Cl. ..... 362/84; 362/231

(58) Field of Classification Search ..... 362/84, 362/230, 231, 249.01, 249.02, 249.06
See application file for complete search history.

(56) References Cited

U.S. PATENT DOCUMENTS

2004/0196643 A1* 10/2004 Terada et al. ..... 362/3
2008/0259589 A1* 10/2008 Van De Ven ..... 362/84
2009/0201662 A1* 8/2009 Kim ..... 362/84

* cited by examiner

*Primary Examiner* — Laura Tso

(57) ABSTRACT

An LED device with high color-rendering index includes a substrate; three white light units arranged on the substrate, each of the white light units being an LED element that combines a blue light chip with fluorescent glue to produce a mixed light; and a red light unit arranged on the substrate among the three white light units and being an LED element that combines a red light chip with fluorescent powder to produced a mixed light. With the specific arrangement of positioning the red light unit among three white light units, a mixed light produced by the LED device is a visually comfortable warm white light with high color-rendering index. Therefore, the LED device can be used in an environment where a large quantity of LEDs are needed, so largely reduces the users' eye discomfort.

7 Claims, 4 Drawing Sheets

LED DEVICE WITH HIGH COLOR-RENDERING INDEX

FIELD OF THE INVENTION

The present invention relates to a light-emitting-diode (LED) device with high color-rendering index, and more particularly to an LED device having preferably disposed white and red light units to enable a high color-rendering index thereof.

BACKGROUND OF THE INVENTION

A conventional white-light light emitting diode (LED) 6, as shown in FIG. 5, includes a printed circuit board 61 having a recess 611, a blue light chip 62 being mounted in the recess 611, and fluorescent glue 63 being filled in the recess 611. The blue light chip 62 can be activated to emit blue light, and the fluorescent glue 63 contains yellow fluorescent powder. With these arrangements, the blue light emitted from the blue light chip 62 can be mixed with the yellow fluorescent powder in the fluorescent glue 63 to radiate preferred white light.

While the described white-light LED 6 can emit white light by incorporating the blue light chip 62 with the fluorescent glue 63, but the color-rendering index of the blue light emitted from the blue light chip 62 and the yellow light emitted by the fluorescent glue 63 is low. As a result, the conventional white-light LED 6 is not able to preferably emit a pure white light by mixing the blue light with the yellow light in the above described manner. That means the white light emitted from the LED 6 is yellowish, a pure white light will not be achieved. Therefore, the conventional white-light LED 6 actually fails to achieve the alleged effect of emitting a white-light with high color-rendering index, and might cause discomfort to users, such as tired and sore eyes, when being used in a large quantity.

SUMMARY OF THE INVENTION

Therefore, it is a primary object of the present invention to provide an LED device with high color-rendering index, so that a comfortable warm white light can be produced, and the shortcomings in the prior art white light LED can be overcome.

To achieve the above and other objects, the LED device with high color-rendering index according to the present invention includes:

a substrate;

three white light units being arranged on the substrate, each of the white light units being an LED element having a blue light chip being incorporated with fluorescent glue, and the fluorescent glue having yellow fluorescent powder blended therein; and a red light unit being arranged on the substrate and being an LED element having a red light chip being incorporated with fluorescent powder.

With the specific arrangement of positioning one red light unit among three white light units, a mixed light produced by the LED device of the present invention is a highly visually comfortable warm white light with high color-rendering index, which is more comfortable to users' eyes. A proportionate light color of such warm white light in the CIE 1931 color system is ranged from about 0.03 above to about 0.03 below a black body radiation locus, and has a human-visible wavelength range between 575 nm and 595 nm. Therefore, the LED device of the present invention can largely reduce the users' eye discomfort when being used in an environment where LEDs are needed.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
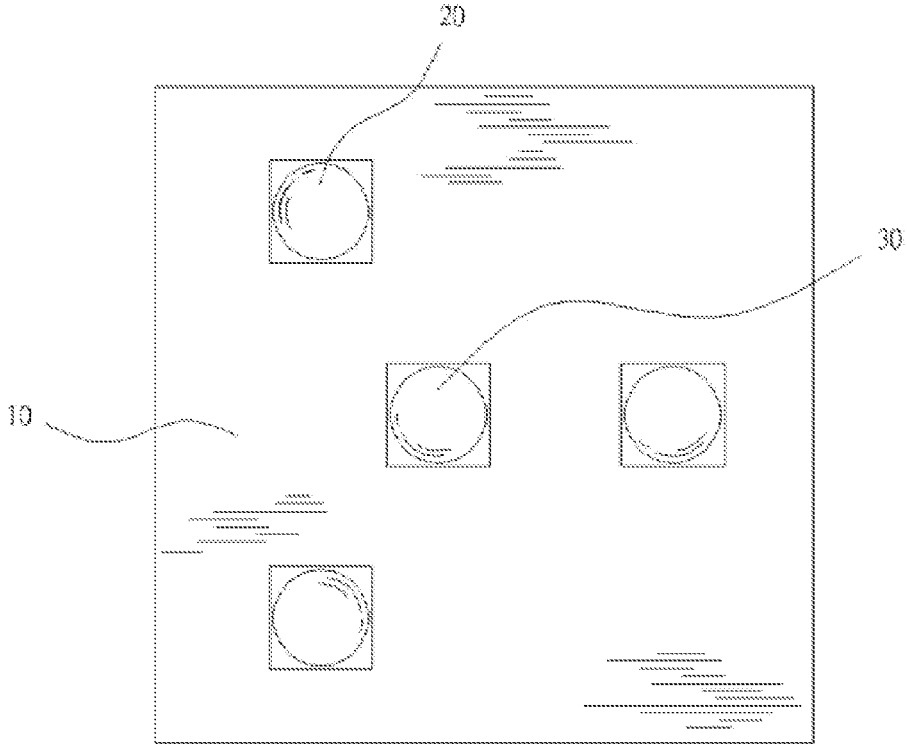
FIG. 1 is a top view of an LED device with high color-rendering index according to a preferred embodiment of the present invention.
Figure 2:
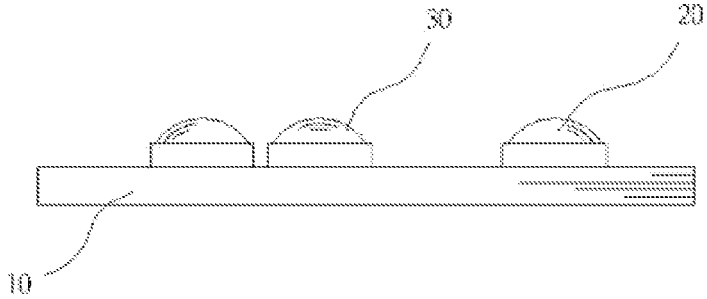
FIG. 2 is a side view of the LED device of FIG. 1.
Figure 3:
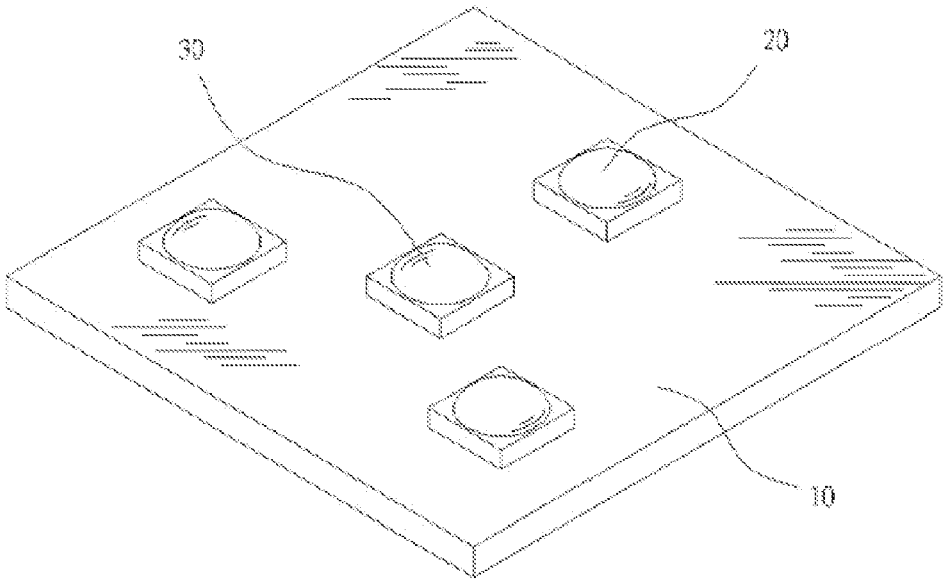
FIG. 3 is a perspective view of the LED device of FIG. 1.

Please refer to FIGS. 1 to 3, which are top, side, and perspective views, respectively, of a light-emitting-diode (LED) device with high color-rendering index according to a preferred embodiment of the present invention. As shown, the LED device comprises a substrate 10, three white light units 20, and a red light unit 30.

The substrate 10 is a plate having a predetermined thickness and made of a material with high thermal conductivity.

The white light units 20 are arranged on the substrate 10 and can be disposed in any geometrical pattern. Each of the white light units 20 is an LED element that incorporates a blue light chip with fluorescent glue to emit a mixed light. Since the fluorescent glue has yellow fluorescent powder blended therein, the LED element can be activated to emit an approximate white light. Please further refer to FIG. 4 as well, in which a CIE 1931 xy chromaticity diagram is shown. The location of the white light emitted by the preferred white light unit 20 of the present invention on the CIE 1931 xy chromaticity diagram is indicated by the block 70, of which the X value is ranged between 0.3 and 0.4, and the Y value is ranged between 0.4 and 0.5. Moreover, the white light emitted by the white light unit 20 is yellowish and has a human-visible wavelength ranged between 540 nm and 580 nm.

The red light unit 30 is arranged on the substrate 10 at an appropriate position among the three white light units 20, and is an LED element incorporating a red light chip with fluorescent powder to emit a mixed red light. The fluorescent powder may be green fluorescent powder and a dispersing agent. The light emitted by the red light chip has a human-visible wavelength range substantially between 585 nm and 640 nm, and a purity degree above 95%. For the purpose of obtaining an enhanced color mixing effect, the red light chip is incorporated with the fluorescent powder to ensure that the light produced by the red light unit 30 has a wavelength range between 595 nm and 625 nm, as indicated by the block 80 in FIG. 4.

Figure 4:
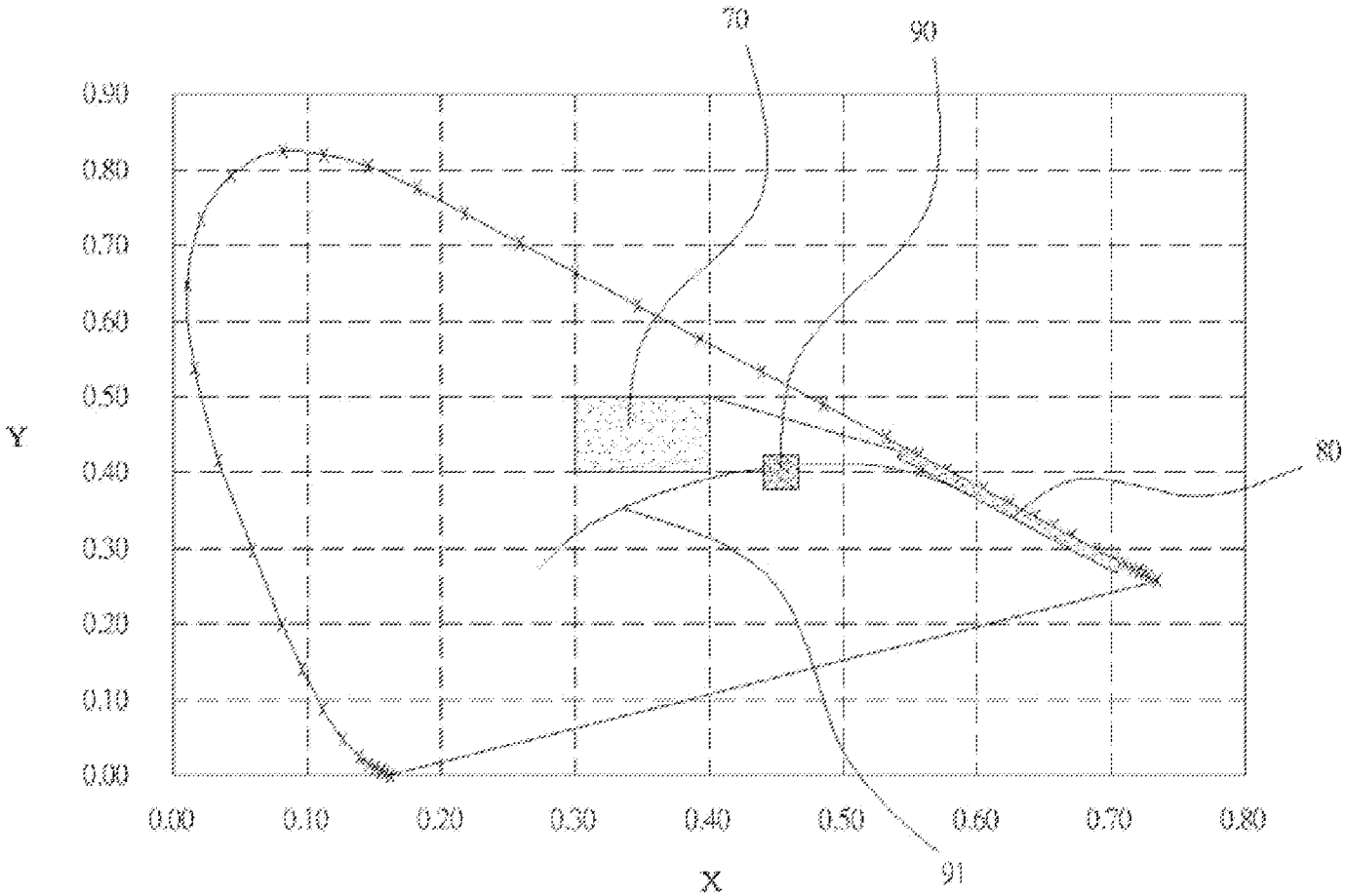
FIG. 4 shows the light emitted by the LED device of the present invention in a CIE 1931 xy chromaticity diagram.
Figure 5:
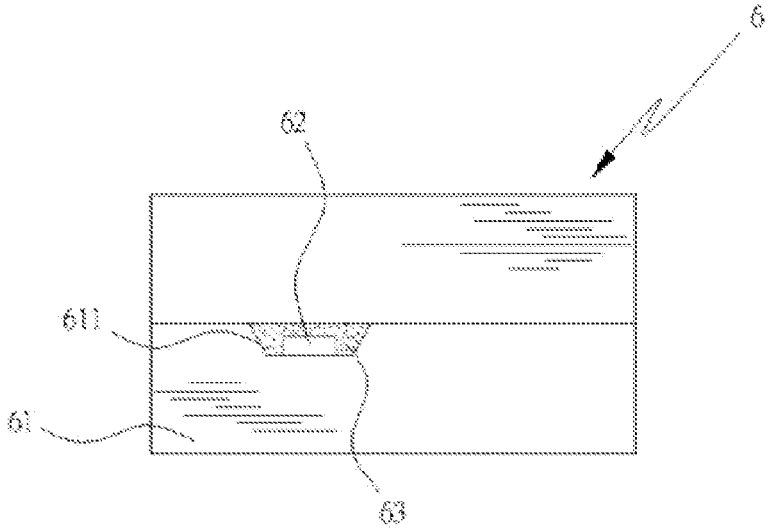
FIG. 5 is a sectioned side view of a conventional white-light LED.

With the specific arrangement of positioning one red light unit 30 among three white light units 20 to mix the lights them emit, the drawback of the low color-rendering index of the white light units 20 can be reduced, and the LED device of the present invention is able to produce warm white light with high color-rendering index, which is more comfortable to users' eyes. A proportionate light color of such warm white light, as indicated by the block 90 in the CIE 1931 color system as shown in FIG. 4, is ranged from about 0.03 above to about 0.03 below a black body radiation locus 91 shown in FIG. 4, and has a human-visible wavelength range between 575 nm and 595 nm. Therefore, the LED device of the present invention is suitable for use in an environment where a large quantity of LEDs is needed, because the white light produced by the LED device of the present invention can largely reduce the users' eye discomfort.

Furthermore, at least three white light units 20 and at least one red light unit 30 can be additionally arranged on the substrate 10. However, it is noted a ratio of the number of the white light units 20 to the number of the red light units 30 must always be 3:1. Further, in arranging the white and red light units 20, 30, it is a principle to always group three white light units 20 and one red light unit 30 together into one unit, and all the units might be arranged into a matrix or a circle.

The present invention has been described with a preferred embodiment thereof and it is understood that many changes and modifications in the described embodiment can be carried out without departing from the scope and the spirit of the invention that is intended to be limited only by the appended claims.

What is claimed is:

1. An LED device with high color-rendering index, comprising:

a substrate;

three white light units being arranged on the substrate, each of the white light units being an LED element having a blue light chip being incorporated with fluorescent glue, and the fluorescent glue having yellow fluorescent powder blended therein; and a red light unit being arranged on the substrate and being an LED element having a red light chip being incorporated with fluorescent powder.

2. The LED device with high color-rendering index as claimed in claim 1, wherein the fluorescent powder incorporated with the red light chip is green fluorescent powder and a dispersing agent.

3. The LED device with high color-rendering index as claimed in claim 1, wherein the white light units are disposed on the substrate in any geometrical pattern, and the red light unit is disposed at an appropriate position among the three white light units.

4. The LED device with high color-rendering index as claimed in claim 1, wherein the mixed light emitted by the white light unit in a CIE 1931 color system has a X value ranged between 0.3 and 0.4, a Y value ranged between 0.4 and 0.5, and a human-visible wavelength range between 540 nm and 580 nm; and the mixed light emitted by the red light unit has a human-visible wavelength range between 595 nm and 625 nm.

5. The LED device with high color-rendering index as claimed in claim 1, wherein the invention emits light in a proportionate light color in a CIE 1931 color system is ranged from about 0.03 above to about 0.03 below a black body radiation locus, and has a wavelength range between 575 nm and 595 nm.

6. The LED device with high color-rendering index as claimed in claim 1, wherein the invention further comprises at least three additional white light units and at least one additional red light unit arranged on the substrate, and a ratio of the number of the additional white light units to the number of the additional red light units is always 3:1.

7. The LED device with high color-rendering index as claimed in claim 6, wherein each three white light units and a corresponding red light unit are grouped together into one unit, and the all units are arranged into a matrix or a circle.

* * * * *